US005095552A

United States Patent [19]

Parkinson

[11] Patent Number: 5,095,552

[45] Date of Patent: Mar. 17, 1992

[54] HELMET FACE GUARD MOUNT

[76] Inventor: Lee J. Parkinson, 11553 Torrey Pines, Auburn, Calif. 95603

[21] Appl. No.: 633,004

[22] Filed: Dec. 24, 1990

[51] Int. Cl.[5] ..... A41D 13/00; A42B 3/00

[52] U.S. Cl. ..... 2/424; 2/9

[58] Field of Search ..... 2/9, 424, 425, 422

[56] References Cited

U.S. PATENT DOCUMENTS

| | | | |
|---|---|---|---|
| 3,139,624 | 7/1964 | Humphrey . | |
| 3,263,236 | 8/1966 | Humphrey . | |
| 3,729,746 | 5/1973 | Humphrey . | |
| 3,815,152 | 6/1974 | Bednarczuk et al. | 2/9 |
| 3,897,598 | 8/1975 | Bednarczuk et al. | 2/9 |
| 3,900,897 | 8/1975 | Dunning . | |
| 4,028,743 | 6/1977 | Christensen . | |
| 4,233,687 | 11/1980 | Lancellotti . | |
| 4,370,759 | 2/1983 | Zide . | |
| 4,390,995 | 7/1983 | Walck . | |
| 4,631,758 | 12/1986 | Newman et al. . | |
| 4,633,531 | 1/1987 | Nimmons . | |
| 4,689,835 | 9/1987 | Draft et al. . | |
| 4,692,947 | 9/1987 | Black et al. | 2/425 |
| 4,774,729 | 10/1988 | Coates et al. . | |
| 4,831,668 | 5/1989 | Schule . | |
| 4,837,866 | 6/1989 | Rector et al. | 2/424 |

*Primary Examiner*—Werner H. Schroeder
*Assistant Examiner*—Michael A. Neas
*Attorney, Agent, or Firm*—Jerry T. Kearns

[57] ABSTRACT

A helmet face guard mount includes a thin, elongated resilient pad having a curved configuration dimensioned for securement between an ear hole and a forward side edge of a conventional football helmet. Opposite ends of the pad are secured by threaded fasteners directly to the helmet. A resilient strap extends around a side bar portion of the face guard and is secured to a central portion of the pad, intermediate the opposite ends of the pad. The central portion of the pad and the attached strap are free to shift within the physical elastic limits of the pad upon application of force to the face guard. The fasteners which secure the pad to the helmet, may be at least partially integral with the pad. The strap which secures the face guard to the pad may also be integrally formed with the pad.

20 Claims, 5 Drawing Sheets

HELMET FACE GUARD MOUNT

BACKGROUND OF THE INVENTION

1. Field of the Invention

The present invention relates to helmet face guard mounts, and more particularly pertains to a shock absorbing mount for securing a face guard to a football helmet. The face guards or masks of football and other types of helmets are subject to a variety of types of applied forces. In football helmets in particular, the face guards are frequently subject to pulling and twisting forces applied by an opposing player grasping the face guard of a player's helmet. These forces can and have frequently resulted in head, and especially neck injuries to helmet wearers. The present invention is directed to a mounting device for securing a face guard to a helmet which minimizes, absorbs or dampens force transmission from the face guard to the helmet, and hence from the helmet to the wearer's head and neck.

2. Description of the Prior Art

Various types of helmet face guard mounts are known in the prior art which utilize resilient straps or clips to secure a face guard to a helmet in such a manner to absorb or dampen some forces applied to the face guard. Some types of face guard mounts proposed in the prior art utilize a break-away construction adapted to at least partially release the face guard from the helmet when excessive forces are applied to the face guard.

SUMMARY OF THE INVENTION

A helmet face guard mount includes a thin, elongated resilient pad having a curved configuration dimensioned for securement between an ear hole and a forward side edge of a conventional football helmet. Opposite ends of the pad are secured by threaded fasteners directly to the helmet. A resilient strap extends around a side bar portion of the face guard and is secured to a central portion of the pad, intermediate the opposite ends of the pad. The central portion of the pad and the attached strap are free to shift within the physical elastic limits of the pad upon application of force to the face guard, for example by impact or by being pulled by a player. The fasteners which secure the pad to the helmet, may be at least partially integral with the pad. The strap which secures the face guard to the pad may also be integrally formed with the pad.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
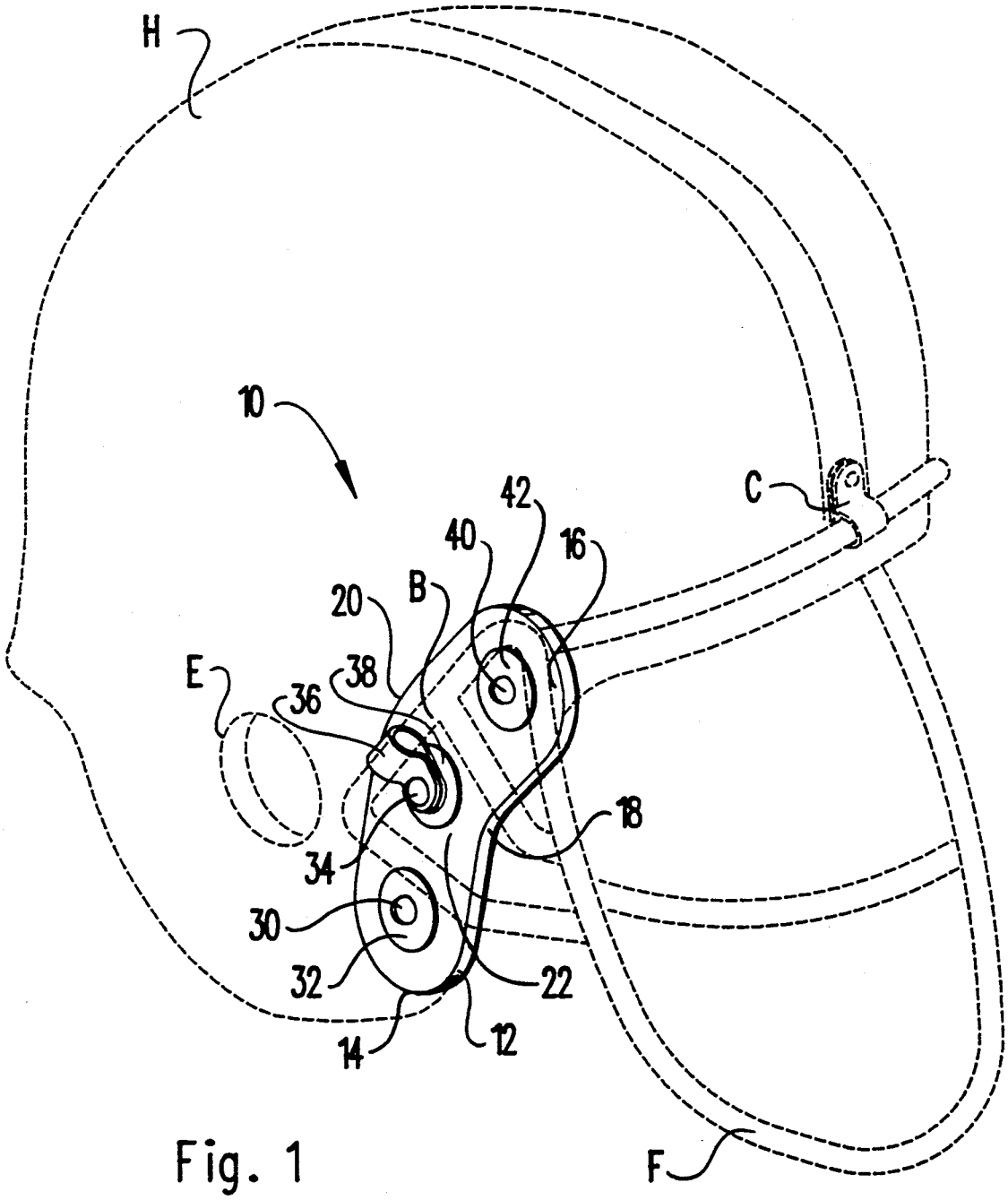
FIG. 1 is a perspective view of a helmet utilizing the helmet face guard mounting pad according to the present invention.

With reference now to the drawings, and in particular to FIG. 1 thereof, a new and improved helmet face guard mount embodying the principles and concepts of the present invention and generally designated by the reference numeral 10 will be described.

More specifically, it will be noted that the first embodiment 10 of the invention includes a thin, substantially planar elongated pad 12 having arcuate opposite ends 14 and 16 connected by concave 18 and convex 20 opposite side walls. The pad 12 is formed from a resilient material such as flexible plastic, urethane, or rubber with a preferred thickness of about ⅜ of an inch. A suitable material for the pad 12 is #1 Ribbed Smoked Sheet Rubber With Ozone Protector, available from R.M. Holtz Rubber Co., P.O. Box 241002, Lodi, Calif.

95241. The pad 12 has a length of at least about three times its width to allow adequate elastic deformation for shock absorbtion.

Figure 2:
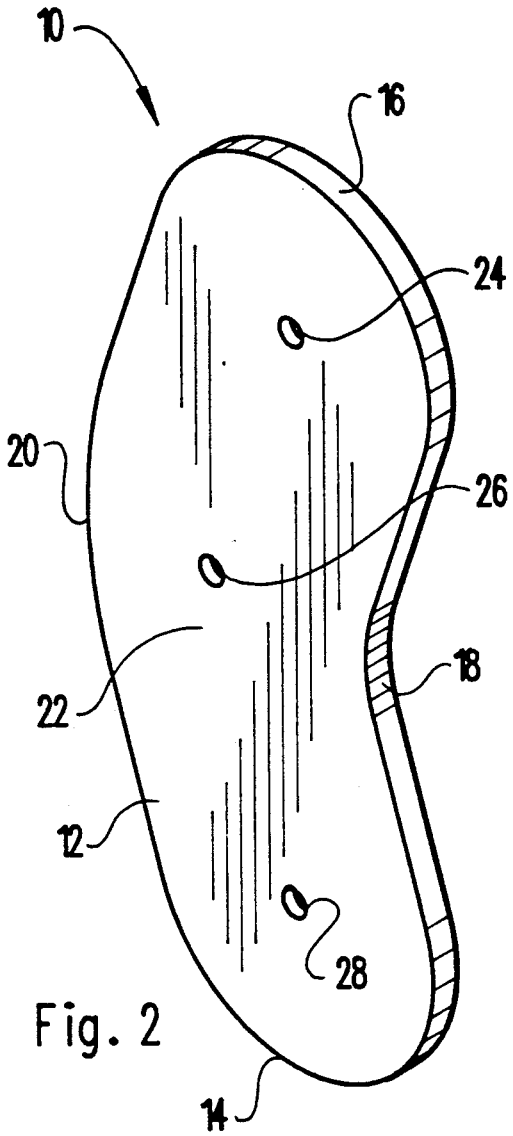
FIG. 2 is a perspective view illustrating the face guard mounting pad according to the present invention.

As may be appreciated from reference to FIGS. 1 and 2, three holes 24, 26, and 28 are spaced substantially uniformly along the pad 12, with holes 24 and 26 disposed adjacent respective opposite ends 16 and 14. Intermediate hole 26 is formed through a central portion 22 of the pad 12. The pad 12 is dimensioned so as to fit between the ear hole E of a conventional football helmet H and the forward side edge of the helmet H which bounds the face opening. The helmet H is preferably of the type having a face guard F composed of a plurality of intersecting, connected tubular members, and including a bar portion B disposed adjacent the region of the helmet H between the ear hole E and the forward side edge of the helmet H. It should be understood that the unillustrated opposite side of the helmet H is a mirror image of the side shown, and hence a full understanding of the invention may be had from a description of the side shown. A conventional clip C secures an upper portion of the face guard F to the helmet H. Some conventional helmets employ a pair of slightly spaced clips to secure the upper portion of the face guard to the helmet, and this alternative construction may also be employed within the scope of the present invention.

Figure 3:
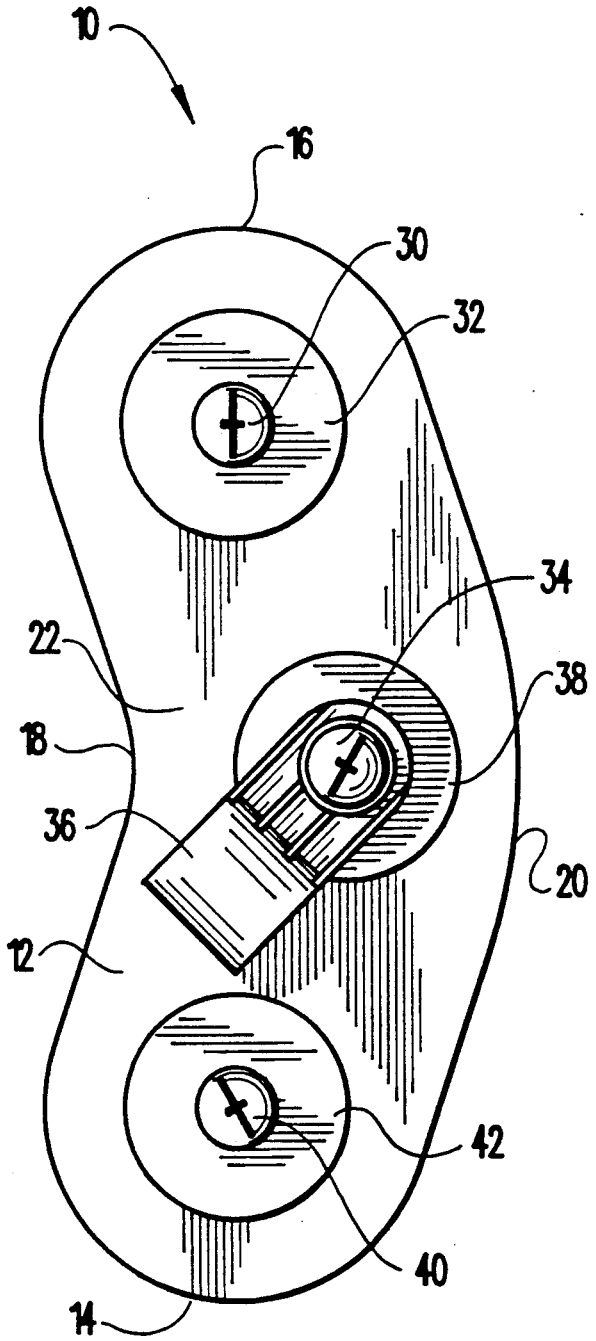
FIG. 3 is a side elevational view illustrating the face guard mounting pad and associated fasteners for securing the pad to a helmet and for securing a face guard to the pad.
Figure 4:
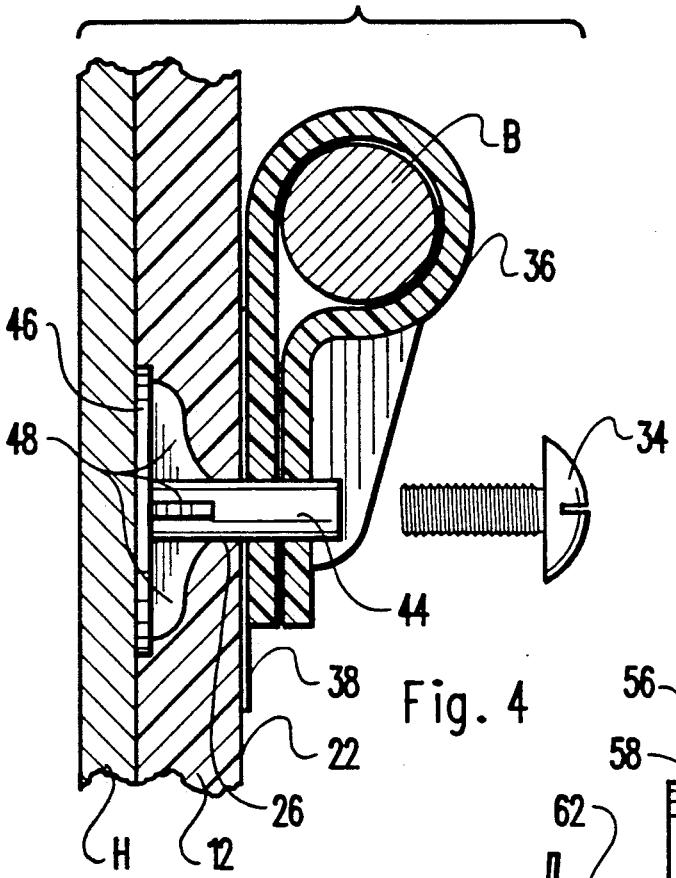
FIG. 4 is a partial cross-sectional detail view illustrating the manner of securement of the face guard to the pad.
Figure 5:
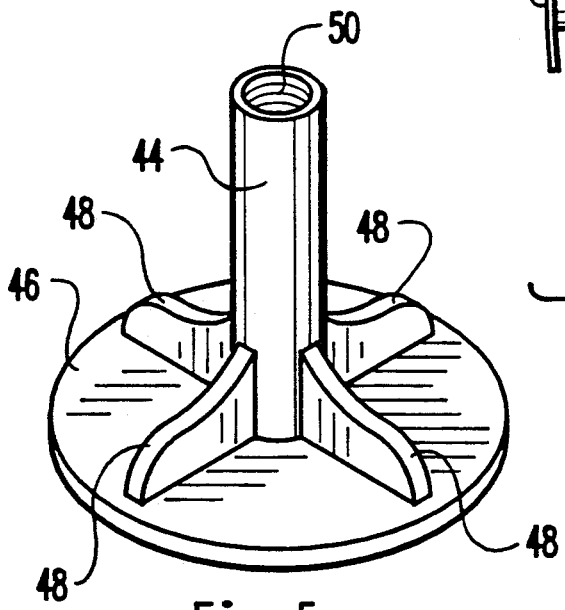
FIG. 5 is a perspective view illustrating a fastener utilized to secure the face guard to the pad.

In use, the opposite ends of the pad 12 are secured fixedly to the helmet H through the use of screws 30 and 40 and associated washers 32 and 42 shown in FIGS. 1 and 3. A resilient strap 36 is adapted to extend around the bar portion B (FIGS. 1 and 4) and has opposite apertured ends through which a screw 34 passes, thus, in conjunction with washer 38, securing the strap 36 to the intermediate central portion 22 of the pad 12. As shown in FIG. 4, the screw 34 is dimensioned for threaded engagement within an internally threaded aperture 50 (FIG. 5) of a sleeve 44 upstanding centrally from a disk 46, and extending through the aperture 26 in the pad 12. The disk 46 has a diameter of about 1.25 inches and includes four uniformly, circumferentially spaced, radially extending ribs 48 with a height above the disk 46 of about ⅛ inches, as shown in FIG. 5. The sleeve 44, disk 46 and ribs 48 may be cast into the pad 12, or inserted into a suitably formed recess. The disk 46 prevents the sleeve 44 from being pulled from the pad 12, while the ribs 48 prevent rotary and lateral deflection of the sleeve 44 with respect to the pad 12. As can be appreciated from FIG. 4, the central portion 22 of the pad 12 overlies, but is not secured to the side wall of the helmet H. Thus, upon exertion of force on the face guard, the bar portion B causes elastic deflection of the strap 36 and pad 12, thus preventing direct force transmission to the helmet H.

Figure 6:
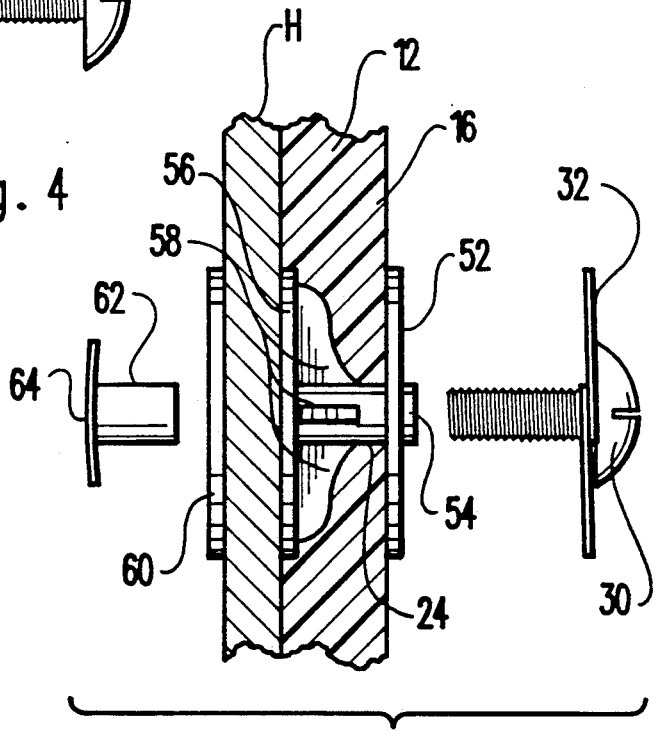
FIG. 6 is a partial cross-sectional detail view illustrating the manner of securement of the pad to the helmet.

FIG. 6 illustrates the manner of securement of the end 16 of the pad 12 to the helmet H. It should be understood that the manner of securement of the opposite end 14 is precisely analogous to the manner of securement of the end 16, and thus need not be separately described or illustrated for a complete understanding of the invention. A non-threaded sleeve 54 extends through the aperture 24 in the pad 12, and is dimensioned for free passage of the screw 32. The sleeve 54 upstands centrally from a disk 56 upon which a plurality of circumferentially space ribs 58 are disposed. The sleeve 54, disk 56 and ribs 58 have a configuration similar to that depicted in FIG. 5. A washer 52 placed over the exposed outer end of the sleeve 54 abuts a lock washer 32 and the pad 12 upon tightening of the screw 30. A similar washer 60 abuts the inner surface of the helmet H and receives an internally threaded T-shaped nut having an enlarged, flat head 64 and a threaded sleeve 62. Thus, the end 16 of the pad 12 and also, in a similar manner, the end 14 is clamped to the helmet H.

Figure 7:
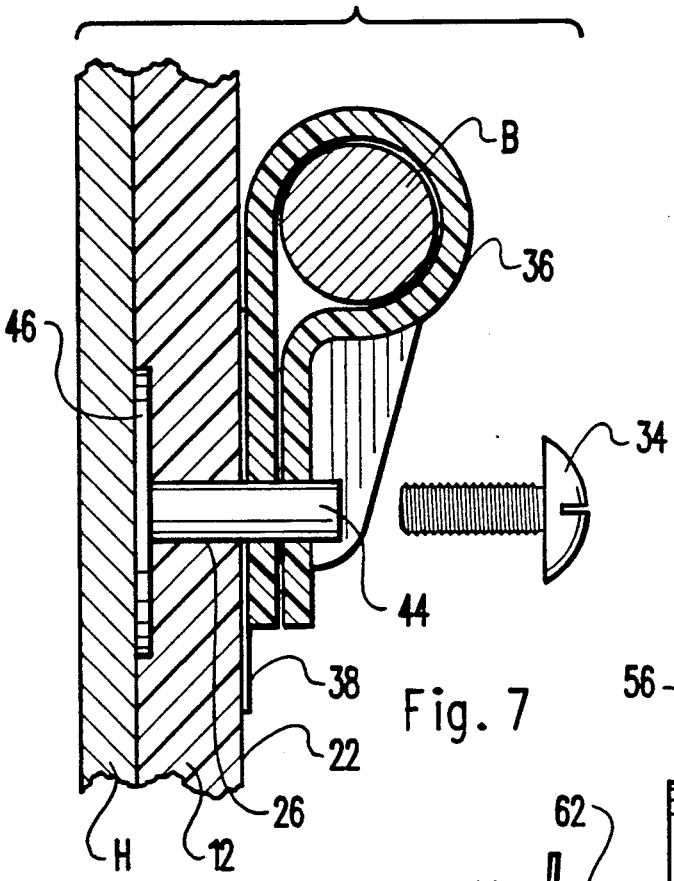
FIG. 7 is a partial cross-sectional detail view illustrating an alternative manner of securement of the face guard to the pad.
Figure 8:
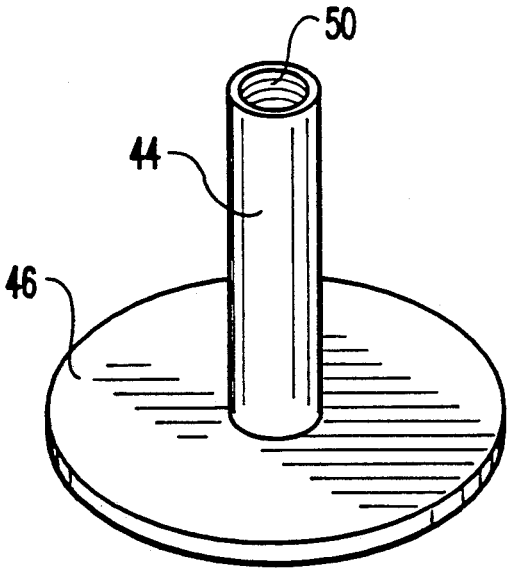
FIG. 8 is a perspective view illustrating an alternative fastener utilized to secure the face guard to the pad.
Figure 9:
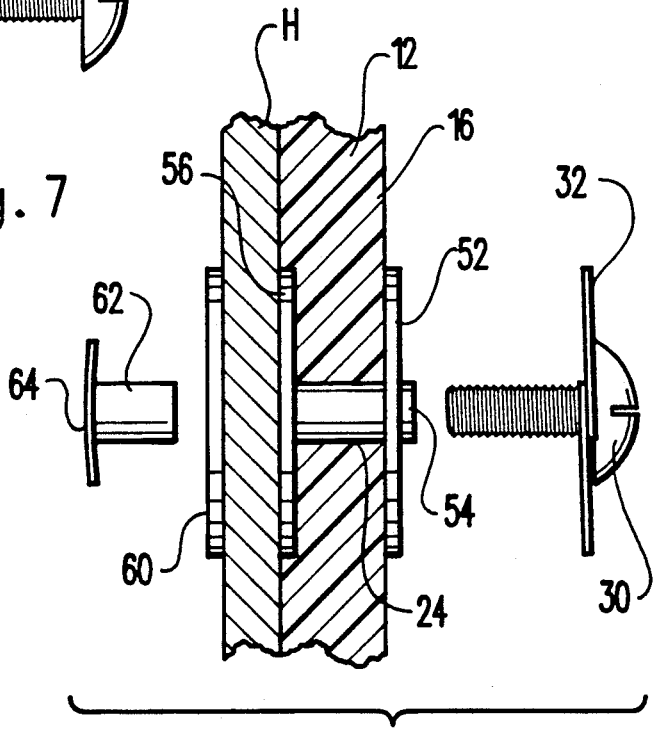
FIG. 9 is a partial cross-sectional detail view illustrating an alternative manner of securement of the pad to the helmet.

FIGS. 7, 8 and 9 illustrate an alternative securement arrangement, identical in all respects to that illustrated and described with reference to FIGS. 4, 5 and 6, with the exception that the ribs 48 and 58 are omitted, with the objective of reducing the possibility of tearing the pad 12 due to a stress concentration around the ribs.

Figure 10:
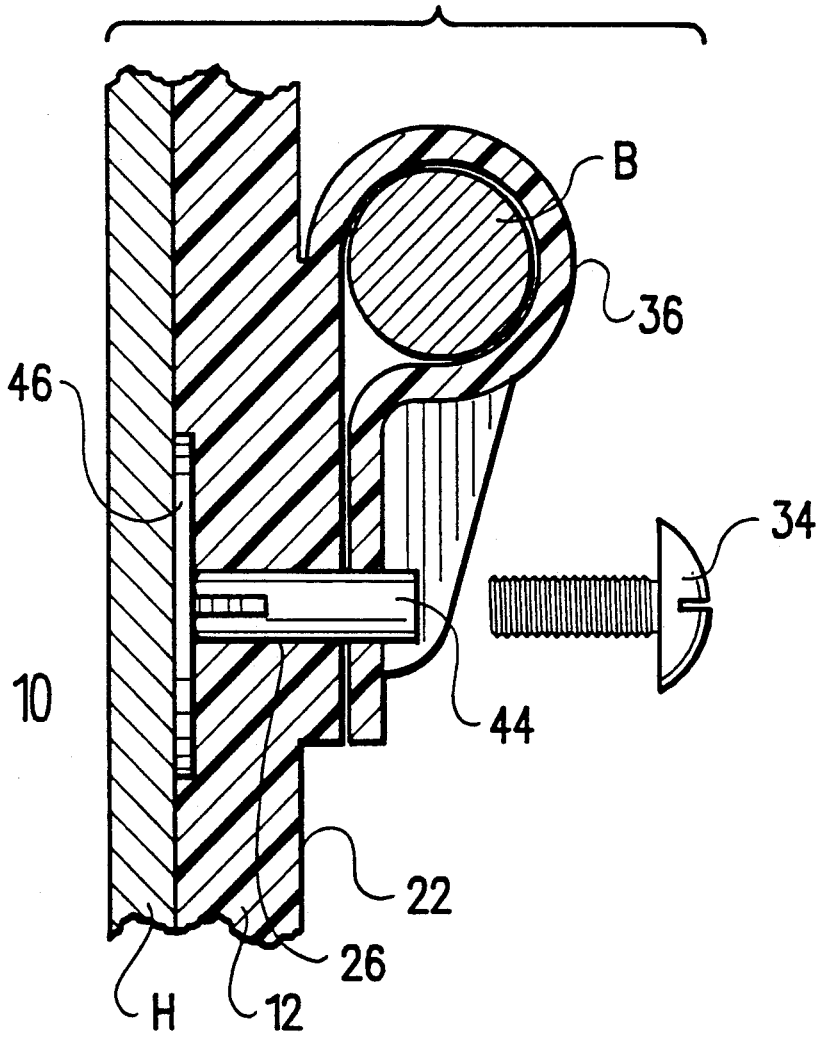
FIG. 10 is a partial cross-sectional detail view illustrating an alternative integral construction of the pad and securing strap.

In another form of the invention, the pad 12 and strap 36 may be integrally molded, as shown in FIG. 10. In this construction, the fastening elements 44, 46 may also be formed integrally with the pad 12, or imbedded therein during the molding process. With such an integral construction, the pad 12 and strap 36 may be advantageously formed of a high strength urethane material.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be emcompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In combination with a helmet possessing a face guard and opposite sidewalls each having an arcuate forward side edge and an ear hole, a face guard mount comprising:

a pair of elongated pads, each of said pads formed from a resilient material and having at least one arcuate side wall dimensioned for conformance with respective ones of said arcuate forward side edges, each of said pads disposed between one of said ear holes and one of said arcuate forward side edges of said helmet;

means securing opposite ends of each of said pads to said sidewalls of said helmet while leaving central portions of said pads free for elastic displacement; and resilient straps securing opposite side portions of said face guard to said central portions of said pads.

2. The combination of claim 1, wherein said means for securing opposite end portions of said pads to said helmet comprises a sleeve upstanding centrally from a disk and extending substantially through said pad.

3. The combination of claim 2, further comprising a plurality of circumferentially spaced ribs disposed on said disk and in engagement with said pad.

4. The combination of claim 1, wherein said pads are formed integrally with said straps.

5. The combination of claim 1, wherein said pads are substantially planar.

6. The combination of claim 1, wherein each of said pads possesses a length of at least substantially three times its width.

7. A helmet face guard mount, comprising:

an elongated resilient pad;

means for securing opposite end portions of said pad to a helmet while leaving a central portion of said pad free for elastic displacement; and a resilient strap connected to said pad and extending around a side bar portion of a face guard for securing a central portion of said pad to a face guard of a helmet.

8. The helmet face guard mount of claim 7, wherein said pad is formed integrally with said strap.

9. The helmet face guard mount of claim 7, wherein said pad possesses at least one arcuate side wall for conformance with a forward side edge of a helmet.

10. The helmet face guard mount of claim 7, wherein said means for securing opposite end portions of said pad to a helmet comprises a sleeve upstanding centrally from a disk and extending substantially through said pad.

11. The helmet face guard mount of claim 10, further comprising a plurality of circumferentially spaced ribs disposed on said disk and in engagement with said pad.

12. The helmet face guard mount of claim 7, wherein said pad is substantially planar.

13. The helmet face guard mount of claim 7, wherein said pad possesses a length of at least substantially three times its width.

14. In combination with a helmet possessing a face guard and opposite sidewalls each having a forward side edge, a face guard mount comprising:

at least one elongated pad formed from a resilient material;

said pad disposed adjacent one of said forward side edges of said helmet and between one of said sidewalls of said helmet and a corresponding side portion of said face guard;

means securing opposite ends of said pad to one of said sidewalls of said helmet while leaving a central portion of said pad free for elastic displacement; and at least one resilient strap securing said side portion of said face guard to said central portion of said pad.

15. The combination of claim 14, wherein said pad is formed integrally with said strap.

16. The combination of claim 14, wherein said pad is substantially planar.

17. The combination of claim 14, wherein said pad has a length of at least substantially three times its width.

18. The helmet face guard mount of claim 14, wherein at least one of said forward side edges of said helmet is arcuate and said pad possesses at least one arcuate side wall for conformance with said arcuate forward side edge.

19. The helmet face guard mount of claim 14, wherein said means for securing opposite end portions of said pad to a helmet comprises a sleeve upstanding centrally from a disk and extending substantially through said pad.

20. The helmet face guard mount of claim 19, further comprising a plurality of circumferentially spaced ribs disposed on said disk and in engagement with said pad.

* * * * *